United States Patent [19]

Sigg

[11] Patent Number: 4,934,105

[45] Date of Patent: Jun. 19, 1990

[54] MEASURING METHOD AND EQUIPMENT FOR THE AUTOMATIC CONTROL OF THE FORWARDS AND BACKWARDS MOVEMENT OF THE GRINDING WHEEL OF A SURFACE GRINDER

[75] Inventor: Hans Sigg, Neuchâtel, Switzerland

[73] Assignee: Meseltron S.A., Corcelles, Switzerland

[21] Appl. No.: 248,065

[22] Filed: Sep. 23, 1988

[30] Foreign Application Priority Data

Oct. 1, 1987 [FR] France ..... 87 13707

[51] Int. Cl.[5] ..... B24B 49/00

[52] U.S. Cl. ..... 51/165.71; 51/165.77; 51/165.87

[58] Field of Search ..... 51/165.77, 165.76, 165.75, 51/165.87, 165.71; 29/407; 33/504

[56] References Cited

U.S. PATENT DOCUMENTS

| | | | |
|---|---|---|---|
| 3,704,557 | 12/1972 | Peonski | 51/165.75 |
| 3,855,736 | 12/1974 | Porter | 51/165.75 |
| 4,288,901 | 9/1981 | Babcock | 29/407 |
| 4,539,777 | 10/1985 | Brown et al. . | |
| 4,577,285 | 3/1986 | Bailey | 33/504 |

FOREIGN PATENT DOCUMENTS

| | | |
|---|---|---|
| 2949427 | 6/1981 | Fed. Rep. of Germany . |
| 545673 | 2/1974 | Switzerland . |

OTHER PUBLICATIONS

Patent Abstracts of Japan, vol. 7, No. 102 (M-211) [1247], 30 Avril 1983; & JP-A-58 22 659 (Mizuguchi Seisakusho K.K.) 10-02-1983.

Patent Abstracts of Japan, vol. 3, No. 130 (M-78), Oct. 27, 1979, p. 34 M 78; & JP-A-54 105 393 (Tokyo Shibaura Denki K.K.) 18-08-1979.

*Primary Examiner*—Frederick R. Schmidt
*Assistant Examiner*—M. Rachuba
*Attorney, Agent, or Firm*—Pollock, Vande Sande & Priddy

[57] ABSTRACT

Measuring method and equipment for automatic control of forward and backward movements of a grinding wheel of a surface grinder. The upper surfaces of the workpieces are felt by means of a length measuring head mounted on the frame of the grinder during different successive passes of these pieces under the grinding wheel to obtain each time a measuring signal which substantially represents their actual size. A reference block of given thickness composed of one or several pieces is placed on the grinder table, in addition to the pieces to be machined and out of reach of the grinding wheel. The upper surface of this block is periodically felt with the measuring head to obtain a reference signal and the value of this signal is stored each time. The difference between the value of the measuring signal and the stored value of the reference signal is calculated at least once for each of the passes to obtain a resultant signal which corresponds to the exact actual size of the workpieces and is used to control the movements of the grinding wheel so as to avoid measurement errors such as those caused by wear on the head, by deformations in its support, and/or by heat-induced variations in the level of the table.

28 Claims, 4 Drawing Sheets

MEASURING METHOD AND EQUIPMENT FOR THE AUTOMATIC CONTROL OF THE FORWARDS AND BACKWARDS MOVEMENT OF THE GRINDING WHEEL OF A SURFACE GRINDER

BACKGROUND OF THE INVENTION

It is the object of the present invention to provide measuring method for the automatic control of the forwards and backwards movement of the grinding wheel of a surface grinder as well as an equipment for carrying out this method.

DESCRIPTION OF THE PRIOR ART

In the case of a surface grinder, the workpieces are placed on a horizontal table which can turn or move in linear manner on a frame and above which is located a circular grinding wheel having a horizontal or vertical axis and being able to machine the pieces by means of its edge.

This grinding wheel is mounted on a support carried by the frame in such a manner as to be able if desired to turn about its axis and to be able at least to lower and raise itself to be able respectively to be brought in contact with the pieces and to move away therefrom. Generally, when its axis is horizontal, it can moreover be arranged parallel to this axis to be able to grind pieces wider than its own width and/or several rows of pieces arranged side by side.

During machining the horizontal displacement of the table and the forwards movement, that is the vertical descent, of the grinding wheel must be meticulously coordinated and controlled so that the upper surface of the pieces are perfectly polished and attain the desired nominal size with a precision which is very frequently of the order of a micrometer.

To obtain such precision, the size of the pieces is measured in the course of the grinding process and the results of this measurement are used to control the speed of forwards movement of the grinding wheel and to stop this when the desired nominal size has been attained.

Normally the grinding wheel is displaced vertically stepwise or in continuous manner between two successive passes of the horizontal table, that is when this latter occupies an extreme or initial position for which no piece is located under the grinding wheel. Subsequently the level of the grinding wheel is kept constant during one pass.

Grinding usually takes place in three phases: roughing out, during which the speed of forwards movement of the grinding wheel is relatively high, polishing, for which the speed of forwards movement is slower, for example ten times slower and finishing, which is effected by allowing the grinding wheel to make several passes in the same position.

To measure the size of the pieces length measuring heads are currently used which are mounted on a bracket fixed to the frame of the machine and which comprise a probe which feels at least one part of the pieces and a capacitative or inductive transducer which converts the movements of this probe into an electrical measuring signal which is transmitted to a measuring and control apparatus in which it is amplified and used to display the size of the pieces and to produce control signals for the movements of the grinding wheel.

What is, in fact, measured with this system is not the exact size of the pieces, but the level of their upper surface in relation to a horizontal plane bound to the frame of the machine and, in so doing, it is assumed that the height of the table is rigorously constant in relation to this plane.

This solution is not satisfactory since there are at least three possible causes of error for the measurements. The first is the wear of the probe on the measuring head. The second is the deformation of the bracket under the influence of the heat produced during the machining operations and of the draught caused by the grinding wheel. The third is that when the temperature varies, the height of the table changes. For example, if it is carried on an oil film, its height diminishes when the temperature increases. If it is mounted on bearings, the reverse occurs.

To eliminate at least some of these errors it has been proposed to use a second head charged to feel the surface of the table and to subtract the signal provided by this second head from that produced by the first, but in doing so other sources of error are introduced. There is a risk that the probes of the two heads will wear at different speeds. The table can also wear, bearing in mind that the probe of the second head always rubs on the same spot. Finally, in the case of a magnetic table, the shavings produced whilst the workpieces are being machined adhere to the surface thereof to such an extent that this probe is generally unable to remove these from its trajectory.

The object of the invention is to provide a new measuring method which does not have the disadvantages of these two known measurements methods discussed above.

BRIEF SUMMARY OF INVENTION

This object is achieved due to the fact that the measuring method of the invention consists not only of feeling the upper surface of at least part of the workpieces by means of a length measuring head mounted on the frame of the grinder during different successive passes of these pieces under the grinding wheel to obtain in each case a measurement signal which substantially represents their actual size but also in initially placing on the table, in addition to the workpieces and out of the range of the grinding wheel a reference block of determined thickness, in periodically feeling the upper surface of this reference block with the measuring head to obtain a reference signal and in storing the value of this signal each time, and in calculating at least once for each of said passes, the difference between the value of the measurement signal and the stored value of the reference signal to obtain a resulting signal which corresponds to the exact actual size of the workpieces and which can be used to control the forwards and backwards movements of the grinding wheel.

BRIEF DESCRIPTION OF THE INVENTION

It should be noted that the word "feel" must be understood here in the broad sense. As a matter of fact, to implement the method of the invention one can use a mechanical measuring head such as those referred to and which have a probe and a transducer, but also a pneumatic measuring head and, in this case, on can bear in mind that the head feels the surface of the measured pieces by means of the compressed air which it projects against this surface.

As regards the reference block, this may be composed of a single reference piece or by several pieces stacked one on top of the other.

In addition it can be placed in the field scanned by the grinding wheel or outside this latter, in other words at the side or in the extension thereof.

In the first case it can only remain outside the reach of the grinding wheel when it has a thickness less than the nominal size of the workpieces and it is naturally felt as often as these latter are.

However, in the second case there is nothing against this thickness being greater than or equal to the nominal size of the pieces and the block can be felt less often than these although it must be so relatively frequently if one wishes to ensure that the object of the invention is actually to be achieved because if, for example, the temperature had the time to vary more between two successive feels of the block than between two successive feels of the workpieces the corresponding variation in the measuring signal would no longer be exactly compensated by that of the reference signal and the action of calculating the difference between the values of these two signals would no longer make it possible to make accurate measurements.

Having said this, the information that is generally needed for being displayed and for controlling the movements of the grinding wheel is the excess thickness of the workpieces in relation to their nominal size. Moreover, when one decides to place the reference block outside the field scanned by the grinding wheel, it is unlikely that one still has a set of reference pieces sufficient to always be able to constitute a block of a thickness equal to the nominal size of the pieces which are being ground.

The procedure of the invention will therefore most frequently consist of calculating, by means of operations carried out in any order, the algebraic sum of the difference between the value of the measurement signal and the stored value of the reference signal and of that between the thickness of the reference block and the nominal size in question.

Finally, as has already been indicated, it is also an object of the invention to provide a measuring apparatus for carrying out the method referred to.

This apparatus which comprises a length measuring head mounted on the frame of the grinder to feel the upper surface of a least one part of the workpieces during different successive passes of these pieces under the grinding wheel and to produce in each time a measurement signal which substantially represents their actual size is principally characterized by the fact that it also comprises a reference block of given thickness intended to be placed initially on the grinder table in addition to workpieces outside the reach of the grinding wheel and to be periodically felt by the measuring head so that the latter then also produces a reference signal, and an electronic measurement circuit which is connected to the measuring head and which comprises means to store the value of the reference signal between two moments when the reference block is felt by the measuring head and calculating means to calculate at least for each of said passes, the difference between the value of the measuring signal and the stored value of the reference signal and to produce a resulting signal which corresponds to the exact actual size of the workpieces.

BRIEF DESCRIPTION OF THE DRAWINGS

Other characteristics and advantages of the invention will appear from study of the following description which refers to the enclosed drawings in which.

DETAILED DESCRIPTION OF THE INVENTION

Figure 1:
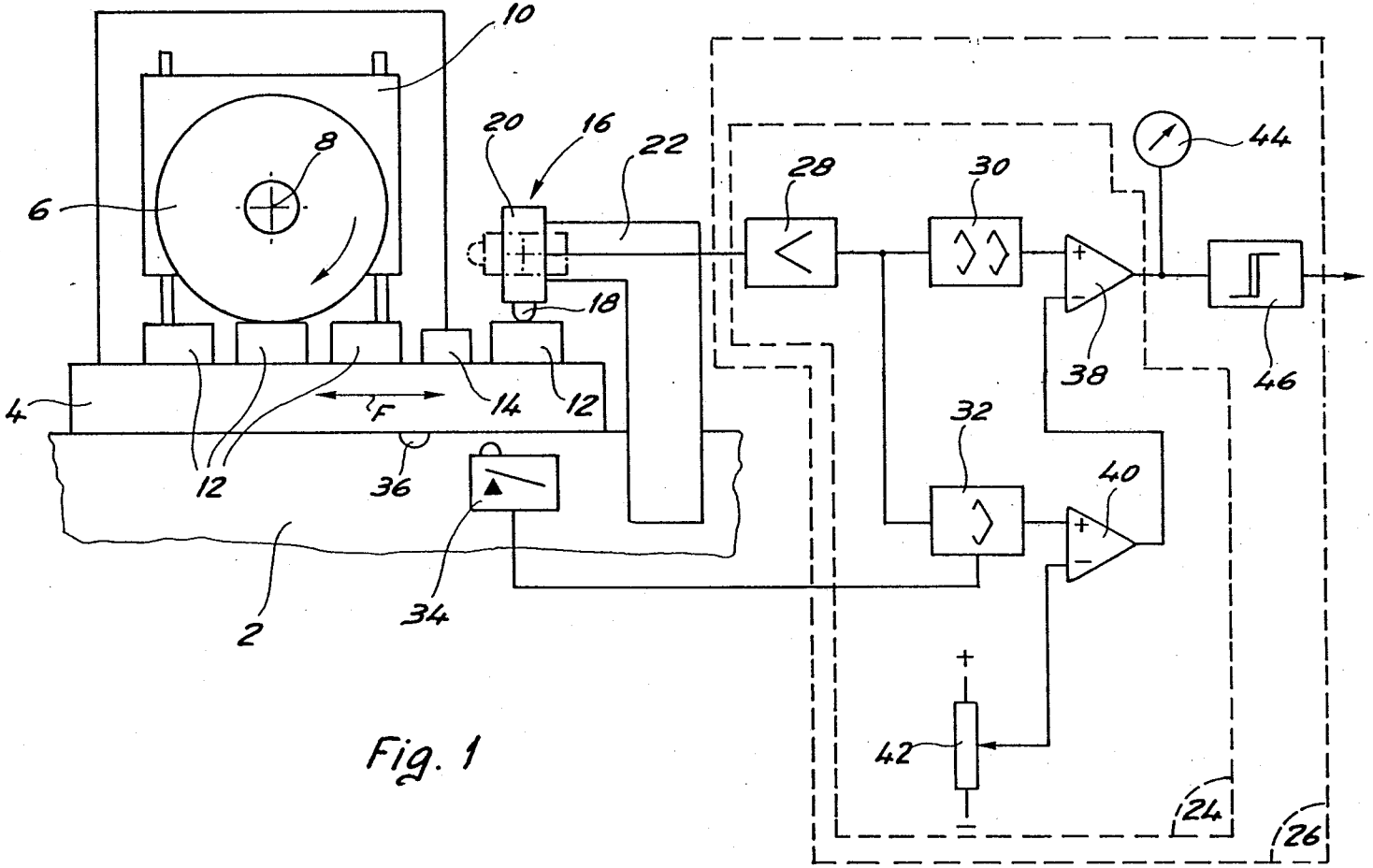
FIG. 1 shows schematically a surface grinder, shown in part, and a first possible embodiment of the measuring equipment according to the invention which has been chosen as an example to illustrate this.

The surface grinder which has been shown both partially and schematically in FIG. 1 comprises a frame 2 which carries, for example by means of an oil film, a horizontal table 4 of the "scanning" type, i.e. a table which can effect a linear forwards and backwards movement on this frame between two extreme positions, as shown by the double arrow F.

Above table 4 is a circular grinding wheel 6 which is able to turn about a horizontal axis 8, orthogonal to the direction of displacement F of this table, and which is mounted on a support 10 which is also carried by the frame 2 in such a way to be able to be displaced vertically and, if necessary, also in a parallel direction to the axis 8.

There is also shown in FIG. 1 a row of pieces 12 to be machined or in course of machining between two of which a single reference piece 14 has been interposed which presents upper and lower faces that are perfectly planar and parallel to each other, the height of which is known with great precision.

In addition, as is shown here in the position in which this reference piece is located in the field scanned by the grinding wheel, its height is a little less than the nominal size that the pieces 12 must have at the end of their machining.

In this first embodiment which has been chosen as an example, the length measuring head 16 which is designed to feel the surface of the workpieces 12 and of the reference piece 14 is a conventional mechanical measuring head which comprises a probe 18 and an inductive or capacitive transducer (not shown) mounted inside a housing 20 from which this probe partially protrudes.

This measuring head is mounted at the end of the crossbeam of a very rigid bracket 22 which is integral with the frame of the grinder by the intermediary of a bearing without play which is not shown in FIG. 1, but of which a possible form of embodiment will be described hereafter, in such a manner as to be able to pivot about an axis between a measuring position shown in a solid line on the drawing and a disengaged position shown in a dotted line which are situated at 90° to one another and defined by stops which are also not shown.

This way of lifting the head has at least two advantages: it facilitates the exchanging of the workpieces and if necessary also of the reference piece and it makes it possible to avoid damage to the head when the extra thickness of the pieces to be machined is important.

When it is in the measuring position, the head 16 feels the surface of the workpieces 12 during each pass or at least some of these as well as that of the reference piece 14 and it then produces a signal which is transmitted to an electronic measuring circuit 24 included in a measuring and control apparatus 26, itself connected to the drive unit (not shown) of the grinder.

Since the reference piece 14 is placed here amongst the workpieces this signal produced by the head 16 contains both the above mentioned measurement signal and the reference signal which represent respectively the level of the upper surface of the workpieces and that of the upper surface of the reference piece in relation to any horizontal plane connected to the frame 2. The electronic measuring circuit 24 must therefore be capable of separating these two signals.

On the other hand, the signal provided by the measuring head also contains parts which correspond to the traversing by the probe 18 of the gaps between the pieces and possible to that of grooves, irregularities or other hollows which maY be present on the upper surface of the workpieces.

If one did not take special precautions, these "interruptions" of the worked surface, i.e. of the surface which includes the upper surfaces of all the pieces, would be interpreted by the autocalibration system of the grinder as being that the size of the pieces was too small. Moreover, the display means responsible for indicating the size of the pieces, which is also in the measuring and control apparatus and which has the reference numeral 44 in FIG. 1, would display changing values and it would be difficult to know exactly the real or effective size of the pieces at a given moment.

These two problems of separating the measuring and reference signals and of the interruptions of the worked surface are solved in the measuring circuit 24 in the following manner:

The signal from the measuring head is first amplified, such as it is, by an amplifier 28.

The amplified signal is then transmitted on the one hand to a storage circuit 30, responsible for bridging the above mentioned interruptions or more precisely to eliminate the parts of the signal which correspond to these interruptions and on the other hand, to a sample and hold circuit 32 responsible for recording the value of the amplified reference signal at the moment when the measuring head feels the reference piece and of storing this value until this is reproduced.

In order that it knows at what moment it must record the value of the signal transmitted to it, this circuit 32 is connected to a switch 34 which is actuated by a cam integral with the table at the moment when the measuring head feels the reference piece and which then applies a sample signal thereto.

Another possibility would be to use an inductive proximity detector in place of a switch.

As shown in FIG. 1, the switch 34 and the cam 36 are placed under the table, but they could equally well be located on the side or even on top thereof.

It should, moreover, be explained that this switch and this cam are not needed for a numerical control grinder. Indeed, in this case the drive unit of the machine can know at what moment the reference piece passes under the measuring head and itself supply a sample signal to the sample and hold circuit.

Figure 2:
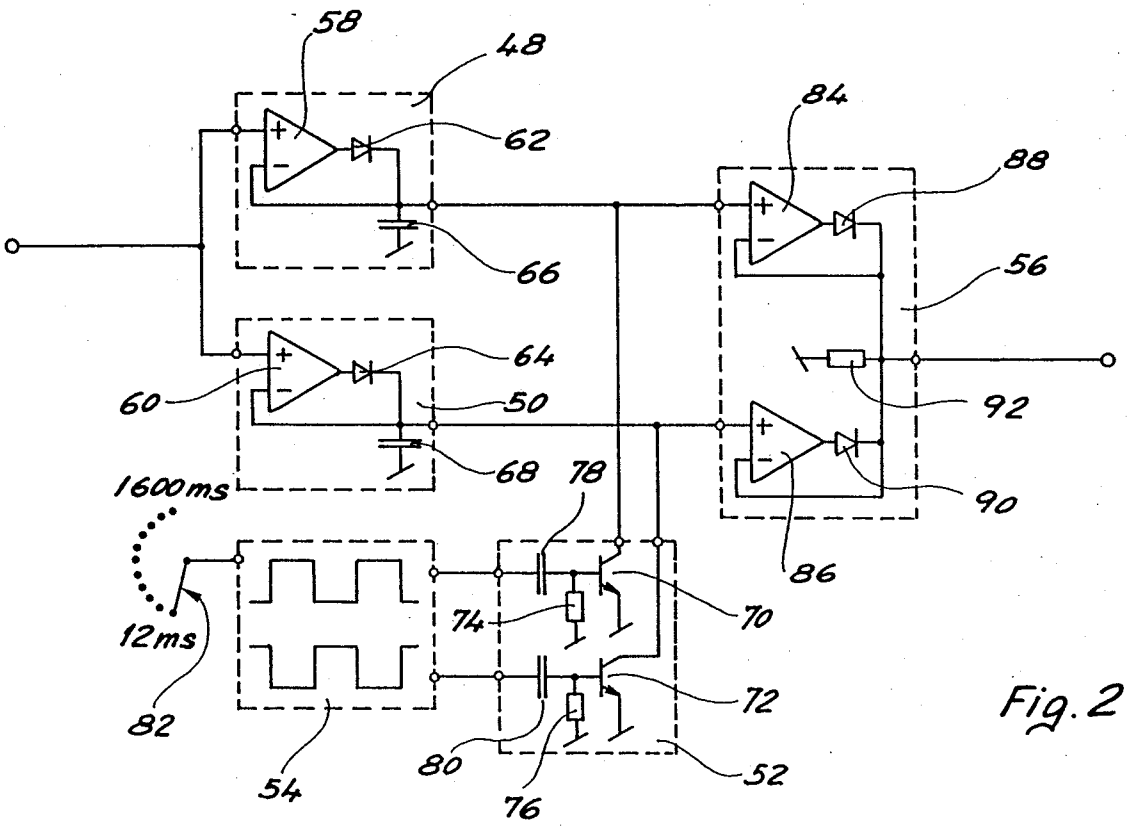
FIG. 2 is a block diagram of a storage circuit used in the electronic measurement circuit of the equipment shown in FIG. 1.

FIG. 2 shows how the storage circuit 30 is constructed.

This circuit, which is already extensively used to serve the same function in measuring and control apparatus for machine tools and not only for surface grinders, comprises two identical analog memories 48 and 50 which both receive the signal coming from the amplifier 28 (see FIG. 1), a circuit 52 controlled by a clock 54 to discharge periodically and alternately these two memories and another circuit 56 to permanently select the highest of the two respective values which they contain and to supply this value to its output.

The two memories 48 and 50 are designed as peak detectors.

More specifically, each of them is composed of a circuit which comprises an operational amplifier 58, respectively 60, the non-inverting input of which is connected to the output of the amplifier 28, a diode 62, respectively 64, which connect the output of this amplifier on the one hand to its inverting input in such a manner that it is subjected to negative feedback when this diode is conductive and, on the other hand, to the circuit output and a capacitor 66, respectively 68, connected between this output and earth.

Consequently, between two successive periods during which it is discharged, each of these two memories is charged up to the maximum value of the part of the signal which is applied to it at that given moment.

The discharge circuit 52 has, for each memory, a bipolar transistor 70, respectively 72, for example of the n-p-n type, the conduction path of which connects the output of this memory to earth and the base of which is connected to one of the two outputs of the clock 54 via the intermediary of a differentiating circuit composed of a resistor 74, respectively 76, and a capacitor 78, respectively 80.

For these two memories to discharge in turn it is of course necessary for the transistor 70 to become conductive whilst the transistor 72 is blocked and vice versa.

The clock 54 is therefore designed to produce two rectangular periodical signals having opposite phases which are transformed by differentiating circuits 74,78 and 76,80 into two other signals of the same period and also in phase opposition each formed by impulses of alternating polarity, of a duration that is much shorter than the half period of the rectangular signals from which they originate and which only operate at the rate of one out of two to render in turn the transistors 70 and 72 conductive.

More precisely, each positive pulse which is produced by one of the differentiating circuits at the same time as a negative pulse is produced by the other simply has a straight leading edge which corresponds to that of a positive half-alternation of the rectangular signal from which it is derived and an exponential trailing edge and this pulse makes it possible to cause the transistor to which it is applied to become conductive.

Inversely, each negative pulse which is produced by this same differentiating circuit at the same time as a positive pulse is produced by the other has a straight trailing edge which corresponds to that of a negative half-alternation of the rectangular signal and an exponential leading edge and this pulse keeps the transistor to which it is applied blocked.

In addition, thanks to a selecting switch 82 the period of the signals supplied by the clock 54 and of these pulses can adopt various values ranging, for example, between 12 and 1600 ms.

Finally, as regards the circuit 56, it may be seen that this comprises two operational amplifiers 84 and 86, the non-inverting inputs of which are connected to the memory outputs 48 and 50, two diodes 88 and 90 by the intermediary of which the outputs of these amplifiers are connected both to their respective inverting inputs and to the output of the circuit and a resistor 92 connected between this output and earth.

It is evident that the storage circuit which has just been described can only play its part correctly if at any moment at least one of these two memories contains a useful measured value, that is a value which does not correspond to an interval between two pieces or to hollows of any shape which these could have. In other words, it is necessary for the period of the signals produced by the clock to be greater than the time required by the feeler on the measuring head to jump over the longest of these interruptions including that which corresponds to the passage of the probe on the reference piece. When this condition is fulfilled the circuit yields an output signal which constantly represents the level of the highest points of the worked surface.

Referring again to FIG. 1 it will be noted that the measuring circuit 24 also comprises two operational amplifiers 38 and 40, the non-inverting inputs of which are respectively connected to the outputs of the storage circuit 30 and of the sample and hold circuit 32.

It will also be noted that the amplifier 40 has its inverting input connected to a potentiometer 42 and its output to the inverting input of the amplifier 38.

The potentiometer 42 serves to initially introduce into the measurement circuit the algebraic value of the difference between the exact thickness of the reference piece and the final size to be attained by the workpieces which is negative in the present case.

This makes it possible to obtain a signal at the output of the amplifier 40 which represents the sum of this final size and of a corrective term equal to the difference between the measured value of the level of the upper surface of the reference piece and its thickness, and then at the output of the amplifier 38 a resulting signal which is also the output signal from the electronic measuring circuit and which corresponds exactly to the difference between the true nominal size of the highest points of the machined surface and said final size.

Subsequently, the process continues as in conventional measuring and control apparatus, i.e. the output signal of the measuring circuit is applied to the display device 44, already referred to, which indicates the extra thickness of the workpieces in relation to their final size, and to different comparison circuits responsible for generating the signals which make it possible to control the forwards and backwards movements of the grinding wheel.

The figure shows one of these comparators composed, for example, of a Schmitt trigger which is designated by the reference numeral 46 and which can be that which produces the control signal for backwards movement of the grinding wheel when the pieces have reached their final size.

Figure 3:
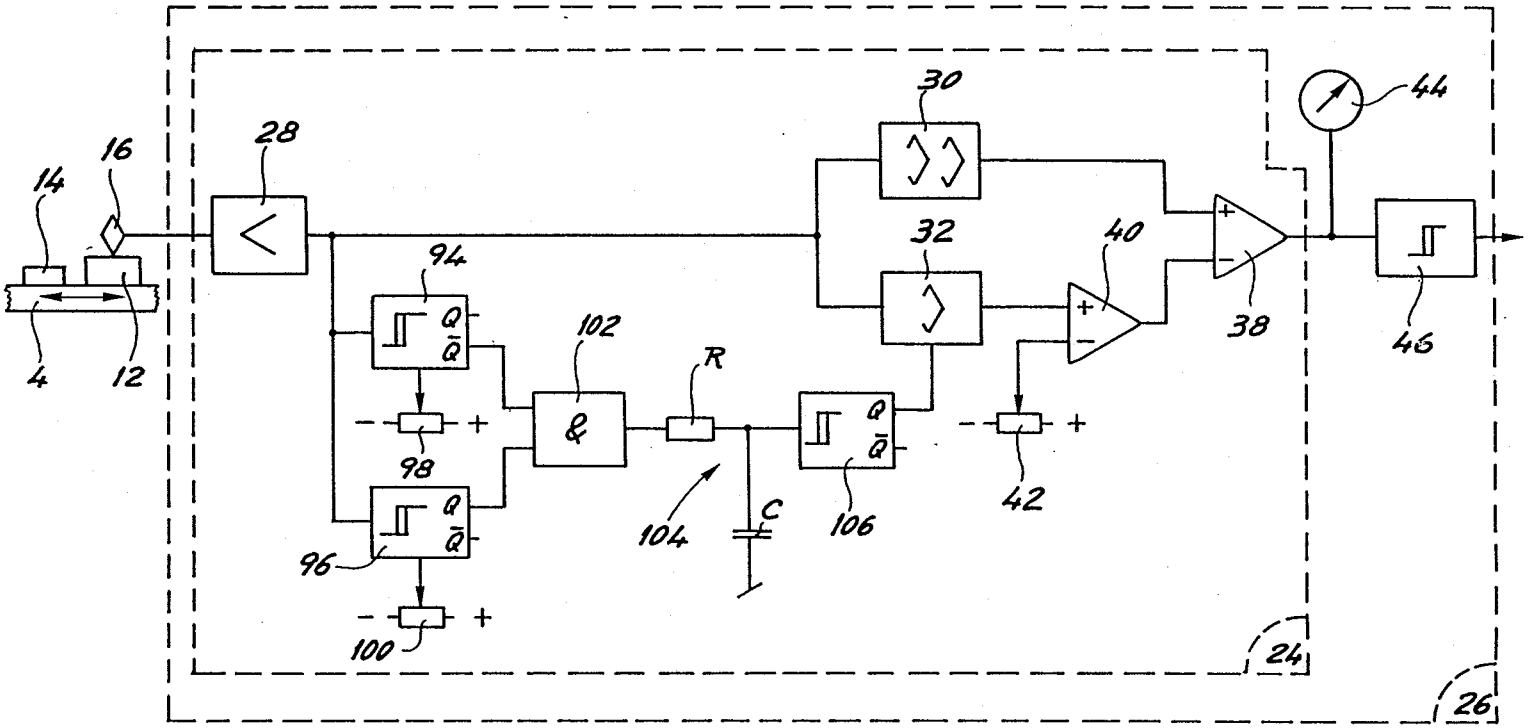
FIG. 3 shows, also schematically and still for purposes of example a second possible embodiment of the equipment according to the invention.

Before describing the second possible embodiment which has been selected as an example to illustrate the invention and which is represented in FIG. 3 it is useful to make at least three remarks regarding what has just been discussed.

The first is that the operations effected by the two operational amplifiers 38 and 40 amount effectively to subtract the value of the reference signal contained in the sample and hold circuit 32 from that of the measuring signal treated by the storage means 30 and to add to the result the difference between the thickness of the reference piece and the final size of the workpieces, even if in practice one commences by subtracting this difference from the value of the reference signal.

The second remark is that one could very well connect the amplifiers differently for them to effect the operations which make it possible to obtain the resulting signal in a different order.

For example one could begin by effectively subtracting the value of the reference signal from that of the signal provided by the storage circuit 30 and then subtract the difference between the final size and the thickness of the reference piece from the value of the signal obtained.

Finally, the third remark is that one could very well provide two potentiometers to permit the separate introduction into the measuring circuit of the final size and the thickness of the reference piece and three operational amplifiers to produce the resulting signal.

The embodiment in FIG. 3 shows many elements which could be identical to those of the embodiment of FIG. 1 and which, for this reason, are designated with the same reference numerals.

This applies firstly to the reference piece 14 which is placed in the same way as before on a scanning table 4 amongst the workpieces 12 of which only one has been shown.

This also applies to the measuring head 16, shown schematically here by a lozenge, and for the amplifier 28, the storage circuit 30, the sample and hold circuit 32, the operational amplifiers 38 and 40 and the potentiometer 42 which form part of the electronic measuring circuit 24, this latter being capable of inclusion into the same measuring and control apparatus 26 as before, the figure of which again only shows the display means 44 and the comparator 46.

Indeed, the difference between these two embodiments rests solely at the level of the means which produce the sampling signals which enable the sample and hold circuit 32 to know at which moments it must store the value of the signal provided by the amplifier 28.

In the embodiment of FIG. 3, these means are devised to deliver a sampling signal when the value of the composite signal provided by the amplifier 28 remains for a time greater than a minimum determined time between a lower limiting value which is a little less than the measuring value of the reference piece and a greater limiting value between this measuring value of the reference piece and that which corresponds to the nominal size of the workpieces.

They comprise two Schmitt triggers 94 and 96 which both receive the output signal from the amplifier 28.

The first, 94, of these triggers is connected to a first potentiometer 98 which makes it possible to adjust its lower or descending threshold to the upper limit which has just been referred to and has its complementary output $\overline{Q}$ connected to one of the two inputs of an AND gate 102.

On the other hand, the second trigger 96 is connected to a second potentiometer 100 which makes it possible to regulate its high or rising threshold to the upper limiting value which has also just been discussed and has its output Q connected to the other input of the AND gate 102.

Thus, when the value of the composite signal from the amplifier 28 is above the upper limiting value, the complementary output $\overline{Q}$ of the trigger 94 is at the logical level "0" when the output Q of the trigger 96 is at the level "1".

Conversely, when the value of the composite signal is below the lower limiting value, the output $\overline{Q}$ of the trigger 94 is at "1" when the output Q of the trigger 96 is at "0".

Thus, in both cases, the output of the AND gate 102 is at "0". On the other hand, when the value of the composite signal is between the two limiting values, the two outputs of the triggers are at "1", which means that the output of the AND gate is too.

Consequently, when the probe of the measuring head 16 feels the pieces whilst the table 4 of the grinder moves, one obtains not only a relatively long pulse at the output of the AND gate when this probe passes over the reference piece, but also shorter pulses at the moments when it crosses the gaps between the pieces.

Moreover, if the threshold of the trigger 94 corresponds to a level very close to that of the upper surface of the reference piece it is possible that, at the moment when it rises on this piece, after having descended into the gap separating it from one of the neighboring workpieces, the probe oscillates sufficiently for one or several short pulses to appear also because of this at the output of the AND gate.

Regardless of their origin, these short pulses should not, of course, reach the sample and hold circuit 32.

It is for this reason that a delay circuit RC 104 is located after the AND gate which only transmits pulses the duration of which is equal to or greater than a determined value and which of course includes the long pulse which it receives at the moment at which the measuring probe passes over the reference piece.

Having crossed this circuit, this long pulse is restored to shape by another Schmitt trigger 106 and then applied to the sample and hold circuit which is connected to the output Q of this trigger 106.

It should be noted that any possible grooves, countersinks or other hollows which the workpieces could present have not been taken into account here.

If such hollows exist and if their dimension in the direction of displacement of the table is comparable to those of the intervals between the pieces they are simply an additional cause of the appearance of short pulses at the output of the AND gate.

If, on the other hand, this dimension is largely equal to or greater than that of the reference piece, the depth of the hollows in question should be outside the limits which correspond to the thresholds of the triggers 94 and 96, otherwise these hollows would also give rise to long pulses and the embodiment which has just been described would no longer function properly.

Finally, it should also be noted that the three remarks which were made earlier in connection with the operational amplifiers and the calculations which they effect also apply to this second embodiment.

Figure 4:
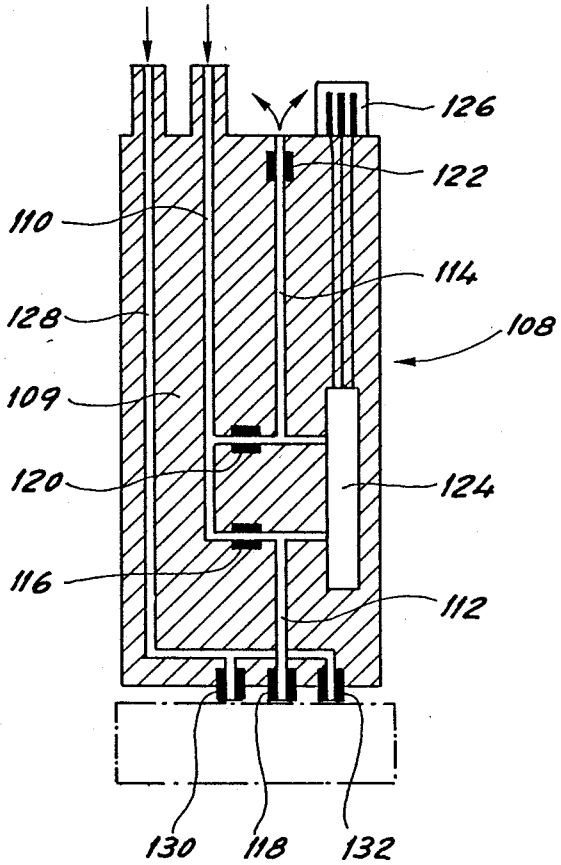
FIG. 4 is a longitudinal section of a pneumatic measuring head which may advantageously be used in the equipment according to the invention.

FIG. 4 shows schematically, in section, a pneumatic measuring head which is often advantageously able to replace a mechanical type head in a measuring equipment according to the invention.

This head, which is designated by the reference numeral 108, is composed of, for example, a cylindrical or parallelipipedal body 109, in which are located a pneumatic measuring system and a system which makes it possible to clean the surface of the pieces to be measured.

The measuring system comprises a pipe 110 which is conventionally connected to a source (not shown) providing compressed air at a regulated pressure and which divides into two branches 112 and 114.

One of these branches, 112, is delimited by an input nozzle 116 and a measuring nozzle 118 situated at the end of the body 109 which is designed to be brought opposite and close to the surface of the pieces to be measured.

The other branch 114 is delimited by an input nozzle 120 and a reference nozzle 122 which can be regulatable.

In addition, these two branches are connected to a differential pressure transducer having a semi-conductor element 124 which is electrically connected to a connection terminal 126 permitting it to be supplied and to collect the signal representing the difference in pressure between the branches which it supplies.

This transducer 124, which could be connected to the amplifier 28 of the measuring circuit 24 if one were to replace the measuring head 16 by that which is being described, is essentially composed of a semi-conductor plate in which a chemical membrane has been formed, a bridge of piezo resistances formed on this membrane and amplifying elements.

Reference is made to French patent application No. 2 266 314 for further information on the design, operation and manufacture of this type of transducer.

As for the principle of the measurement of the sizes of a piece by pneumatic means and by differential pressure, it is well known (see for example DIN standard 2271).

Generally speaking, the advantages of pneumatic measurement as compared to measurement by contact are the absence of wear on the head, improved time constant, negligible hysteresis improved resolution and insensitivity to mechanical vibrations and shocks.

To conclude the discussion on the measuring head of FIG. 4, it is still necessary to discuss its cleaning system which makes it possible to free the surfaces of the measured pieces of, in particular, shavings or of cooling liquid which could be located thereon before the passage of these pieces under the head.

The cleaning system simply comprises a pipe 128 through which compressed air is delivered at a pressure sufficient to achieve the desired object and which terminates in two nozzles 130 and 132 situated on both sides of the measuring nozzle.

Naturally, when the head it mounted on the frame of the grinder, one must ensure that the three nozzles 130, 132 and 118 are more or less aligned in the direction of displacement of the pieces.

It should be noted that one could also have several cleaning nozzles distributed about the measuring nozzle or, on the contrary, have only one. This second solution could be considered, for example, in the event that measurements would only be made when the grinder table moves in one direction.

Figure 5:
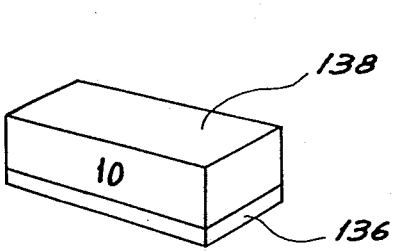
FIG. 5 shows in perspective a reference piece which can also advantageously be used in the equipment according to the invention.

FIG. 5 shows how a reference piece which forms part of the measuring equipment of the invention can advantageously be designed when this equipment is intended for a grinder having a magnetic table.

This piece, which can have engraved thereon a number indicating its thickness, comprises a lower part 136 of magnetic material, for example of normal steel, which enables it to be fixed to the table, surmounted by another part 138, in a non-magnetic material, for example in stainless steel or in hard metal, which prevents shavings adhering to its upper surface.

One can also matters in such a way that it is possible to place standard blocks thereon. For this it suffices if the upper and lower faces of lower part 136 are parallel and perfectly planar so that the blocks can adhere thereto as they do to each other and if its thickness is known as accurately as that of these latter.

In this way one can very easily adapt the level of the reference surface to the thickness of the workpieces by using one or several blocks.

Figure 6:
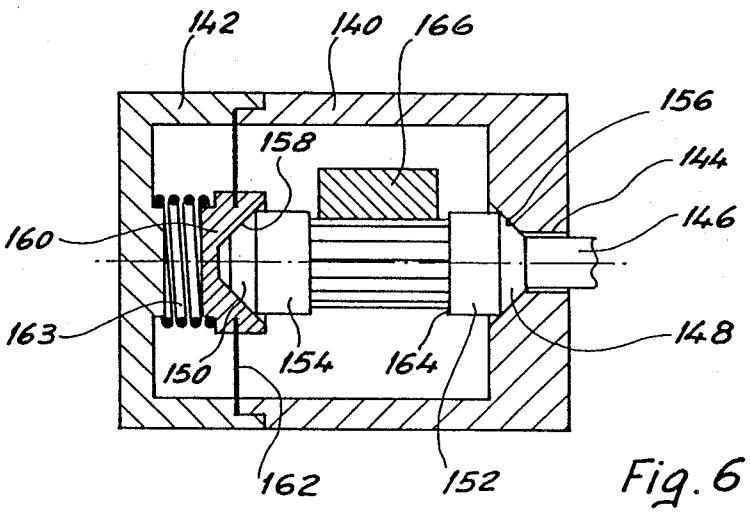
FIG. 6 is a schematic view, in axial section, of a bearing without play by means of which the measuring head of the equipment according to the invention can be mounted on its support.

FIG. 6 shows schematically, in axial section, a tilting bearing which can be used to mount the mechanical or pneumatic measuring head of the measuring equipment of the invention onto its support.

The bearing comprises a cylindrical casing 140 closed by a cover 142, the base of which is pierced by a central hole 144 through which a shaft 146 passes.

Inside, this shaft has two bearing surfaces in the shape of truncated cones 148 and 150, oriented in opposite directions, which are formed respectively by the oblique side of a collar 152 and the beveled part of a head 154 and which are engaged in the two corresponding coaxial seatings in the shape of truncated cones 156 and 158.

The first, seating 156 is simply composed of an internal recess 144.

The second, 158 is formed by a hollow effected in a piece 160 which is fixed in the opening of an annular membrane 162 in such a manner that it can move axially, this membrane being gripped between the collar 140 and the cover 142, and which is permanently pushed against the bearing surface 150 of the shaft 146 by a helical spring 163 placed between it and this cover.

Thus, thanks to the support spring 163 and the truncated cone shape of the bearing surfaces 148 and 150 and the seatings 156 and 158, any possibility of axial or radial play in the shaft 146 is excluded.

Finally, in order to be rotated, this shaft 146 is equipped with teeth which are situated at the base of a groove 154 formed by the collar 152 and the head 154 and which mesh with a rack 166 actuated for example by a pneumatic, hydraulic or electromagnetic piston (not shown).

I claim:

1. A method of measurement for the automatic control of the forwards and backwards movement of the grinding wheel of a surface grinder relative to a horizontal table mounted on a frame for movement under the grinding wheel to permit the latter to scan a field and to machine workpieces placed on the table within this field until these pieces attain a nominal size, said method comprising:

placing on the table within the field scanned by the grinding wheel, a reference block having a thickness less than the nominal size to be attained by the workpieces, feeling the upper surface of at least one of the workpieces by means of a length measuring head mounted on the frame of the grinder during different successive passes of these workpieces under the grinding wheel to obtain each time a measurement signal which substantially represents their actual size, feeling the upper surface of the reference block by means of the measuring head during said successive passes to obtain each time a reference signal and storing the value of this signal, and calculating at least one for each of said passes the difference between the value of said measurement signal and the stored value of said reference signal to obtain a resulting signal which corresponds to the actual size of said workpieces and which can be used for the control of the forwards and backwards movements of the grinding wheel.

2. A method of measurement according to claim 1, wherein there is calculated for each of said passes and by operations effected in any order the algebraic sum of the difference between the value of said measurement signal and the stored value of said reference signal and of that between the thickness of the reference block and said nominal size so that the said resulting signal exactly represents the difference between the actual size of the workpieces and said nominal size.

3. A method of measurement according to claim 1, wherein the reference block is composed of a single reference piece.

4. A method of measurement according to claim 1, wherein the reference block is composed of several reference pieces placed on top of each other.

5. A method of measurement according to claim 4, wherein at least some of said reference pieces are composed of standard blocks.

6. A method of measurement according to claim 1, wherein the storage of the value of the reference signal is controlled by a signal produced by a switch which is actuated by the table at the moment when the measuring head feels the upper surface of the reference block.

7. A method of measurement according to claim 1, wherein the value of the reference signal is stored in response to a signal which is produced by electronic comparison means when the value of the signal provided by the measuring head remains between two limiting values for a predetermined minimum time, one of these values being slightly lower than that of the reference signal and the other higher than that of the reference signal and slightly lower than a value of the measurement signal corresponding to the nominal size of the workpieces.

8. A method of measurement according to claim 1, wherein the measuring head is a mechanical head which comprises a probe which feels the surface of a piece to be measured when in contact therewith and a transducer to convert the movement of this probe into an electrical signal.

9. A method of measurement according to claim 1, wherein the measuring head is a pneumatic measuring head which comprises a measuring nozzle which feels the surface of a piece to be measured by emitting compressed air against this surface and a transducer to convert the variations in pressure inside a pipe which conveys said compressed air to the nozzle into an electrical signal.

10. A method of measurement according to claim 1, wherein said length measuring head feels the upper surface of each of a plurality of the workpieces to obtain said measurement signal.

11. A method of measurement according to claim 1, wherein said length measuring head feels the upper surface of all of the workpieces to obtain said measurement signal.

12. A measuring apparatus for the automatic control of the forwards and backwards movement of the grinding wheel of a surface grinder relative to a horizontal table mounted on a frame for movement under the grinding wheel to permit the latter to scan a field and to machine workpieces placed on the table inside this field until these workpieces reach a nominal size, said apparatus comprising;

a measuring head mounted on the frame of the grinder to feel the upper surface of at least one of the workpieces during different successive passes of these workpieces under the grinding wheel and to produce each time a measuring signal which substantially represents their actual size;

a reference block of a thickness less than the nominal size of the workpieces, said reference block being placeable on the table along with the workpieces in a position inside the field scanned by the grinding wheel so that the measuring head feels the reference block during each of said successive passes and also produces each time a reference signal; and, an electronic measuring circuit which is connected to the measuring head and which comprises first storage means to store the reference value between two moments when the reference block is felt by the measuring head, and calculating means to calculate at least for each of said passes the difference between the value of said measuring signal and the stored value of said reference signal and to produce a resulting signal which corresponds to the actual size of said workpieces and which can be used for the control of the forwards and backwards movements of the grinding wheel.

13. A measuring apparatus according to claim 12, wherein the calculating means are designed to calculate for each of said passes and by means of operations effected in a given order, the algebraic sum of the difference between the value of said measuring signal and the stored value of said reference signal and of that between the thickness of the reference block and said nominal size so that said resulting signal exactly represents the difference between the actual size of the workpieces and said nominal size.

14. A measuring apparatus according to claim 12, wherein the electronic measuring circuit also comprises second storage means capable of temporarily storing the value of the measuring signal to eliminate the parts of this signal which correspond to the intervals between the workpieces.

15. A measuring apparatus according to claim 12, wherein the reference block is composed of a single reference piece.

16. A measuring apparatus according to claim 15, wherein said reference piece has a lower part of magnetic material and an upper part of a non-magnetic material.

17. A measuring apparatus according to claim 12, wherein the reference block comprises several reference pieces placed one on top of the other.

18. A measuring apparatus according to claim 17, wherein one of said reference pieces, which is designed to be placed in contact with the table, has a lower part of a magnetic material and an upper part of a non-magnetic material.

19. A measuring apparatus according to claim 18, wherein the other reference pieces are standard blocks.

20. A measuring apparatus according to claim 12 which also comprises a switch which is actuated by a cam integral with the table at the moment when the measuring head feels the upper surface of the reference block and which then applies a signal to the first storage means in order to store the value of said reference signal.

21. A measuring apparatus according to claim 12, wherein the electronic measuring circuit also comprises comparison means which produce a signal when the value of the signal provided by the measuring head remains between two limiting values during a minimum predetermined period, one of these values being slightly lower than that of the reference signal and the other higher than that of the reference signal and slightly lower than a value of the measurement signal corresponding to the nominal size of the workpieces, and wherein the signal produced by the comparison means is applied to the first storage means for causing it to store at this moment the value of said reference signal.

22. A measuring apparatus according to claim 12, wherein the measuring head is a mechanical head which comprises a probe which feels the surface of a piece to be measured when in contact therewith and a transducer to convert the movements of this probe into an electrical signal.

23. A measuring apparatus according to claim 12, wherein the measuring head is a pneumatic measuring head which comprises a measuring nozzle which feels the surface of a piece to be measured by sending compressed air against this surface and a transducer to convert the variations in pressure inside a pipe which leads said compressed air to the nozzle into an electrical signal.

24. A measuring apparatus according to claim 23, wherein the measuring head comprises at least one supplementary nozzle through which compressed air also escapes to clean the upper surface of the workpieces and of the reference block before the passage of the measuring nozzle to feel this surface.

25. A measuring apparatus according to claim 12, wherein the measuring head is mounted on a support fixed to the frame of the grinder by the intermediary of a tilting bearing which permits it to pivot between a measuring position and a backing off position in which it can be brought outside the periods in which measurements must be effected, and wherein the measuring position at least is determined by a mechanical stop.

26. A measuring apparatus according to claim 25, wherein the tilting bearing comprises a shaft which has two coaxial bearing surfaces in the shape of truncated cones and oriented in opposite directions, two seatings also coaxial and in the shape of truncated cones in which said bearing surfaces are engaged, one of these seatings being axially moveable, and resilient means to press the moveable seating against the corresponding bearing surface and thereby to eliminate all possibility of axial or radial p)ay for the shaft.

27. A measuring apparatus according to claim 12, wherein said length measuring head feels the upper surface of each of a plurality of the workpieces to obtain said measurement signal.

28. A measuring apparatus according to claim 12, wherein said length measuring head feels the upper surface of all of the workpieces to obtain said measurement signal.

* * * * *

UNITED STATES PATENT AND TRADEMARK OFFICE

CERTIFICATE OF CORRECTION

PATENT NO. : 4,934,105

DATED : June 19, 1990

INVENTOR(S) : Hans Sigg

It is certified that error appears in the above-identified patent and that said Letters Patent is hereby corrected as shown below:

Column 14, line 59, change "p)ay" to --play--.

Column 12, line 8, change "one" to --once--.

Signed and Sealed this

Seventh Day of May, 1991

*Attest:*

HARRY F. MANBECK, JR.

*Attesting Officer*

*Commissioner of Patents and Trademarks*